US008217561B2

(12) United States Patent
Fukuzawa et al.

(10) Patent No.: US 8,217,561 B2
(45) Date of Patent: Jul. 10, 2012

(54) SPARK PLUG HAVING LAMINATED GROUND ELECTRODE

(75) Inventors: Reimon Fukuzawa, Aichi (JP); Tomoaki Kato, Nagoya (JP); Akira Suzuki, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 331 days.

(21) Appl. No.: 12/516,227

(22) PCT Filed: Sep. 10, 2008

(86) PCT No.: PCT/JP2008/066308

§ 371 (c)(1),
(2), (4) Date: May 26, 2009

(87) PCT Pub. No.: WO2009/038001

PCT Pub. Date: Mar. 26, 2009

(65) Prior Publication Data

US 2010/0019644 A1 Jan. 28, 2010

(30) Foreign Application Priority Data

Sep. 17, 2007 (JP) ..... 2007-240317
Aug. 27, 2008 (JP) ..... 2008-218736
Sep. 4, 2008 (JP) ..... 2008-226663

(51) Int. Cl.
*H01T 13/20* (2006.01)

(52) U.S. Cl. ..... 313/141

(58) Field of Classification Search ..... 313/141
See application file for complete search history.

(56) References Cited

U.S. PATENT DOCUMENTS 6,166,480 A 12/2000 Ishida et al.
2005/0067933 A1 3/2005 Kato
2005/0168121 A1* 8/2005 Tinwell ..... 313/141
2005/0218771 A1* 10/2005 Hrastnik et al. ..... 313/141

FOREIGN PATENT DOCUMENTS

EP 0 518 707 B1 5/1996
JP 2-295085 12/1990

(Continued)

OTHER PUBLICATIONS

Machine translation of JP 2005-108784.*
Japanese Industrial Standard. 1995. *Spark plugs for internal combustion engines*. Japan. JIS B 8031 (UDC 621.43.045).

*Primary Examiner* — Anne Hines
*Assistant Examiner* — Jacob R Stern
(74) *Attorney, Agent, or Firm* — Stites & Harbison PLLC; Jeffrey A. Haeberlin

(57) ABSTRACT

A spark plug includes: a metal shell having a mounting thread formed with a nominal diameter of M12 or smaller; a ground electrode consisting of a first structural member and at least one ith structural member (i=2, 3, 4, 5) laminated to cover an outer surface thereof, the length of protrusion of the ground electrode from a front end face of the metal shell being 4.5 mm or larger, the ground electrode having a bent portion with a curvature radius of 2.3 mm or smaller; and an electrode tip joined thereto at a position facing the front end of the center electrode and having a protrusion length of 0.5 mm or larger and a cross sectional area of 0.20 to 1.13 $mm^2$. The ground electrode has a total thermal conductivity of 35 W/(m·K) or higher at 20° C.

6 Claims, 5 Drawing Sheets

FOREIGN PATENT DOCUMENTS

| | | | |
|---|---|---|---|
| JP | 4-264378 | | 9/1992 |
| JP | 04-341784 | A | 11/1992 |
| JP | 04-366581 | A | 12/1992 |
| JP | 5-101869 | | 4/1993 |
| JP | 05-159857 | A | 6/1993 |
| JP | 11-185928 | | 7/1999 |
| JP | 2005-135783 | | 5/2005 |
| JP | 2007-80833 | | 3/2007 |

* cited by examiner

SPARK PLUG HAVING LAMINATED GROUND ELECTRODE

TECHNICAL FIELD

The present invention relates to a spark plug having a ground electrode formed with at least one inner layer of high thermal conductivity material and a needle-like electrode tip joined to the ground electrode.

BACKGROUND ART

A spark plug is known, which includes a center electrode, a ground electrode and a needle-like electrode tip joined to an inner surface (side surface) of an end of the ground electrode facing the center electrode so as to define a spark gap between the electrode tip and the center electrode. This type of spark plug allows the ground electrode to be located away from the spark gap and reduces the tendency that a flame core generated in the spark gap comes into contact with the ground electrode in the initial stage of flame growth as compared to conventional spark plugs. It is thus possible to decrease the quenching effect of the ground electrode and improve the ignition performance of the spark plug. This spark plug however decreases in spark wear resistance as the electrode tip gets heated to a high temperature. Against such a backdrop, Patent Document 1 proposes providing a core material of high thermal conductivity in the ground electrode of the spark plug so as to rapidly radiate heat applied from the electrode tip.

In the case of the above spark plug in which the needle-like electrode tip is joined to the ground electrode, the ground electrode needs to be longer by a length of the electrode tip than conventional ground electrodes. Although there has recently been a demand to reduce the size and diameter of the spark plug for engine downsizing and high engine performance, the diameter reduction of the spark plug leads to a smaller radial distance between the ground electrode and the spark gap than conventional ones. In order to prevent the ground electrode from interfering with the growth of the flame core in the spark gap, the radial distance between the ground electrode and the spark gap needs to be secured to some extent at a position corresponding to the spark gap. In other words, it is desired that the ground electrode not only secures an axially extending portion but also has a bent portion located as front as possible by increasing the bending degree of the bent portion (i.e. by decreasing the curvature radius of the inner surface of the ground electrode) in order to allow the end of the ground electrode to face the center electrode while preventing the ground electrode from interfering with the growth of the flame core.

Patent Document 1: Japanese Laid-Open Patent Publication No. 2005-135783

However, it is likely that the internal stress developed in the bent portion of the ground electrode will increase as the minimum curvature radius of the inner surface of the bent portion becomes small. Further, the weight of the ground electrode increases with the length of the ground electrode so that the degree of internal stress developed in the bent portion by vibrations during engine driving becomes relatively high under the increased weight of the ground electrode as well as under the weight of the electrode tip joined to the end of the ground electrode. On the other hand, the heat radiation ability of the ground electrode decreases as the heat radiation passage of the ground electrode (i.e. the passage of heat radiation from the other end to the one end of the ground electrode and then to the metal shell) increases with the length of the ground electrode. There thus arises a possibility that the internal stress exceeds a fatigue limit to cause a breakage, particularly in the bent portion, in a state where the ground electrode decreases in metal fatigue strength under thermal load. This can result in deterioration of the breakage resistance of the ground electrode.

DISCLOSURE OF THE INVENTION

The present invention has been made to solve the above problems. It is an object of the present invention to provide a spark plug having a ground electrode capable of more assured heat radiation so as to protect the ground electrode from decreasing in metal fatigue strength of the ground electrode, prevent the occurrence of a breakage in a stress-prone bent portion of the ground electrode and thereby increase the breakage resistance of the ground electrode.

According to an aspect of the present invention, there is provided a spark plug, comprising: a center electrode; a ceramic insulator having an axial hole extending in an axial direction and retaining the center electrode in the axial hole; a metal shell surrounding a radial outer circumference of the ceramic insulator and retaining therein the ceramic insulator; a ground electrode joined at one end thereof to a front end face of the metal shell and having a bent portion formed between the one end and the other end thereof in such a manner that the other end of the ground electrode faces a front end of the center electrode; and an electrode tip joined to the other end of the ground electrode at a position facing the front end of the center electrode and having a protrusion length of 0.5 mm or larger from the other end of the ground electrode and a cross sectional area of 0.20 to 1.13 $mm^2$, the ground electrode consisting of a first structural member extending from the one end toward the other end of the ground electrode and at least one ith structural member (i=2, 3, 4, 5) laminated to cover an outer surface of the first structural member; the minimum curvature radius of a side surface of the bent portion facing the center electrode being 2.3 mm or smaller; the length of protrusion of a point of the other end of the ground electrode protruding most in the axial direction from the front end face of the metal shell being 4.5 mm or larger; the metal shell having a mounting thread formed with a nominal diameter of M12 or smaller based on JIS standard; and the total thermal conductivity X of the ground electrode as expressed by the formula [1] being 35 W/(m·K) or higher at 20° C.

[Formula 1]

$$X = \frac{\text{volume of first structural member}}{\text{volume of ground electrode}} \times \text{thermal conductivity of first structural member} + \sum_{i=2}^{n}\left(\frac{\text{volume of } ith \text{ structural member}}{\text{volume of ground electrode}} \times \text{thermal conductivity of } ith \text{ structural member}\right) \quad (1)$$

where n is an integer of 2 to 5 indicating the maximum number of the structural members of the ground electrode.

BEST MODE FOR CARRYING OUT THE INVENTION

A spark plug 100 according to one exemplary embodiment of the present invention will be described in detail below with reference to the drawings. Herein, the direction of an axis O of the spark plug 100 is defined as a vertical direction in FIGS. 1 and 2 where the bottom side refers to the front of the spark plug 100 and the top side refers to the rear of the spark plug 100.

Figure 1:
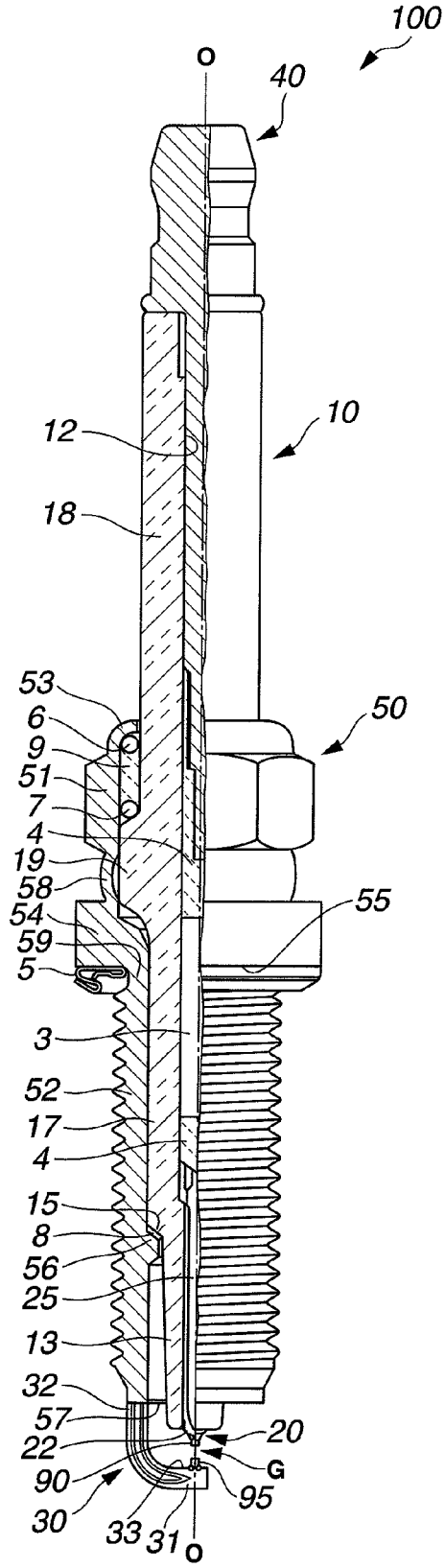
FIG. 1 is a partially sectional view of a spark plug 100 according to one embodiment of the present invention.

As shown in FIG. 1, the spark plug 100 generally includes a ceramic insulator 10 formed with an axial hole 12, a center electrode 20 retained in a front side of the axial hole 12, a metal terminal 40 retained in a rear side of the axial hole 12 and a metal shell 50 surrounding a radial outer circumference of the ceramic insulator 10. The spark plug 100 further includes a ground electrode 30 joined at one end thereof to a front end face 57 of the metal shell 50 and bent in such a manner that the other end (front end 31) of the ground electrode 30 faces the center electrode 20.

The ceramic insulator 10 is made of sintered alumina etc. as is commonly known and formed into a cylindrical shape in which the axial hole 12 extends through the center of the ceramic insulator 10 along the direction of the axis O. The ceramic insulator 10 includes a flange portion 19 located at a substantially middle position of the direction of the axis O and having the largest outer diameter, a rear body portion 18 located on a rear side of the flange portion 19 (a top side in FIG. 1), a front body portion 17 located on a front side of the flange portion 19 (a bottom side in FIG. 1) and having a smaller outer diameter than that of the rear body portion 18 and a leg portion 13 located on a front side of the front body portion 17 and having a smaller outer diameter than that of the front body portion 17. The leg portion 13 decreases in diameter toward the front and, in a state where the spark plug 100 is mounted on a cylinder head of an internal combustion engine (not shown), gets exposed to the inside of a combustion chamber of the engine. The ceramic insulator 10 also includes a stepped portion 15 located between the leg portion 13 and the front body portion 17.

The center electrode 20 is designed as a rod-shaped electrode having a body material of nickel or a nickel-based alloy such as Inconel 600 or 601 (trademark) and a core material 25 made of copper or a copper-based alloy having a higher thermal conductivity than that of the body material and embedded in the body material. The center electrode 20 is retained in the front side of the axial hole 12 of the ceramic insulator 10 with a front end 22 of the center electrode 20 protruding toward the front from a front end of the ceramic insulator 10. The front end 22 of the center electrode 20 decreases in diameter toward the front. For improvements in spark wear resistance, an electrode tip 90 of a noble metal is joined to a front end face of the front end 22 of the center electrode 20.

There is a slight gap left between an inner circumferential surface of the axial hole 12 and an outer circumferential surface of the center electrode 20 facing the inner circumferential surface of the axial hole 12 at a position around a front end portion of the ceramic insulator 10. (See FIG. 2.) In a smoldering state, a corona discharge is generated in this gap so as to burn off carbon adhered to the front end portion of the ceramic insulator 10 and recover the insulation resistance of the ceramic insulator 10. The center electrode 20 is inserted toward the rear in the axial hole 12 and electrically connected to the metal terminal 40 through a ceramic resistor 3 and sealing members 4. A high-voltage cable (not shown) is connected to the metal terminal 40 through a plug cap (not shown) so as to apply a high voltage to the metal terminal 40.

The metal shell 50 is designed as a cylindrical fitting for fixing the spark plug 100 to the cylinder head of the internal combustion engine while surrounding part of the ceramic insulator 10 from an end of the rear body portion 18 through the leg portion 13 to retain therein the ceramic insulator 10 as shown in FIG. 1. The metal shell 50 is made of low-carbon steel and has a tool engagement portion 51 formed to engage with a spark plug wrench (not shown) and a mounting thread portion 52 formed with a thread to screw into a mounting hole of the engine cylinder head (not shown).

Further, the metal shell 50 has a flanged sealing portion 54 formed between the tool engagement portion 51 and the mounting thread portion 52. A thread neck 59 is provided between the mounting thread portion 52 and the sealing portion 54. An annular gasket 5, made by bending a plate material, is fitted on the thread neck 59. In a state where the spark plug 100 is mounted in the mounting hole of the engine cylinder head (not shown), the gasket 5 is crushed and deformed between a bearing surface 55 of the sealing portion 54 and an opening edge of the mounting hole to provide a seal therebetween for preventing engine gas leakage through the mounting hole.

The metal shell 50 also has a thin swaged portion 53 formed on a rear side of the tool engagement portion 51 and a thin buckling portion 58 formed between the tool engagement portion 51 and the sealing portion 54 in the same manner as the swaged portion 53. Annular ring members 6 and 7 are interposed between an outer circumferential surface of the rear body portion 18 of the ceramic insulator 10 and an inner circumferential surface of the tool engagement portion 51 and swaged portion 53 of the metal shell 50. A talc powder (talc) 9 is filled between the ring members 6 and 7. The ceramic insulator 10 is pressed toward the front within the metal shell 50 via the ring members 6 and 7 and the talc 9 by swaging to bend the swaged portion 53 inwardly. The metal shell 50 and the ceramic insulator 10 are thus combined together, with the stepped portion 15 of the ceramic insulator 10 supported via an annular plate packing 8 on a stepped portion 56 of an inner circumferential surface of the metal shell 50 at a position corresponding to the mounting thread portion 52. At this time, the gastightness between the metal shell 50 and the ceramic insulator 10 is kept by the plate packing 8 for prevention of combustion gas leakage. The buckling portion 58 is bent and deformed outwardly with the application of a compression force during the swaging so as to increase the compression length of the talc 9 in the direction of the axis O and improve the gastightness of the metal shell 50.

Figure 2:
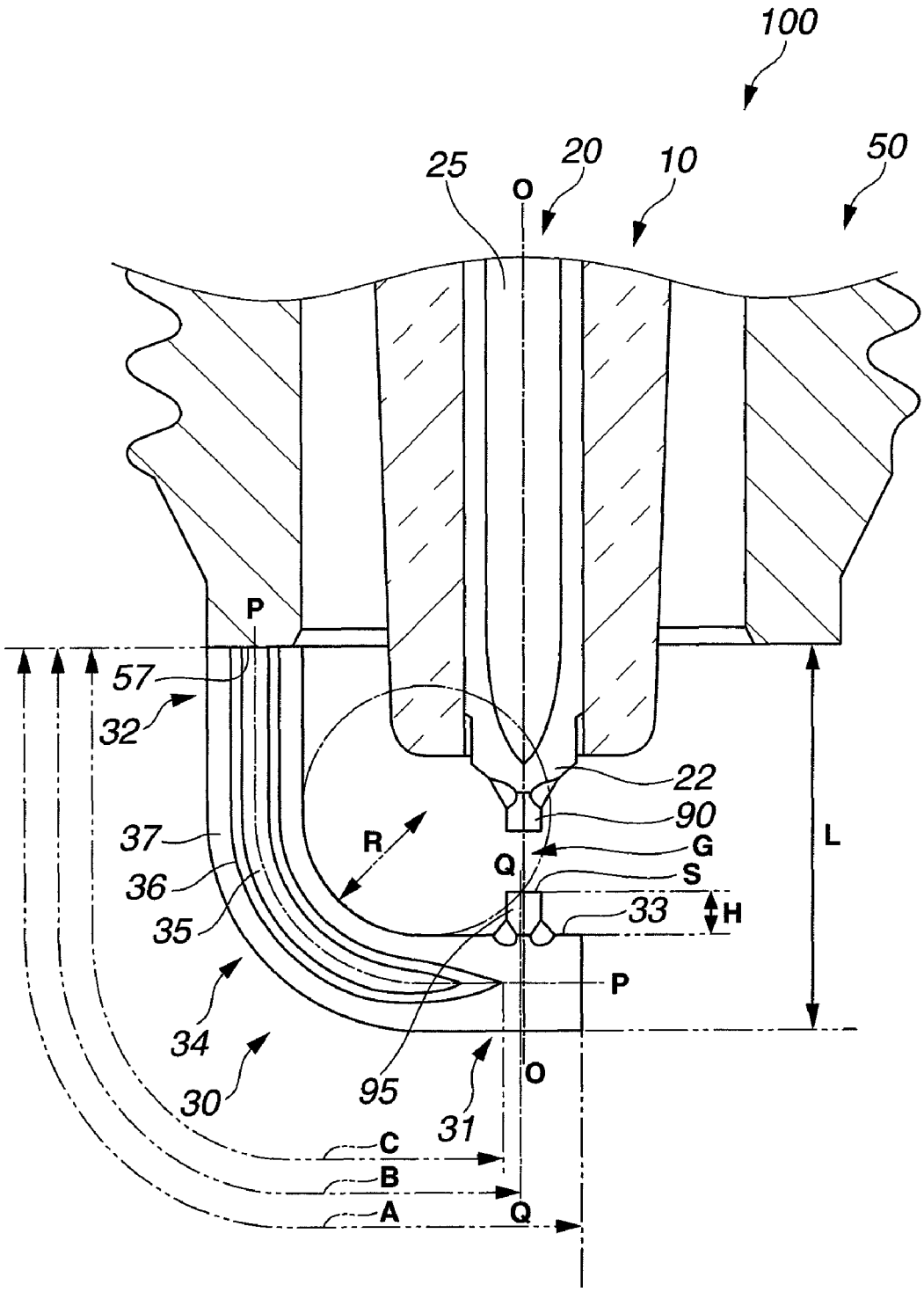
FIG. 2 is an enlarged view of part of the spark plug 100 including a front end 22 of a center electrode 20 according to one embodiment of the present invention.

As shown in FIG. 2, the ground electrode 30 is formed into a rectangular cross-section rod shape. One end (base end 32) of the ground electrode 30 is joined to the front end face 57 of the metal shell 50 and extended along the direction of the axis O, whereas the ground electrode 30 is bent to form a bent portion 34 such that a side surface (inner surface 33) of the other end (front end 31) of the ground electrode 30 faces the front end 22 of the center electrode 20. The ground electrode 30 has a layer structure consisting of a first structural member and at least one more structural member laminated to cover an outer surface of the first structural member, preferably a layer structure of two to five structural members. By way of example, the ground electrode 30 has a layer structure consisting of a first structural member 35, a second structural member 36 laminated on an outer surface of the first structural member 35 and a third structural member 37 laminated on an outer surface of the second structural member 36 in the present embodiment. The first structural member 35, the second structural member 36 and the third structural member 37 extend from the base end 32 toward the front end 31 of the ground electrode 30. Among them, the first and second structural members 35 and 36 has respective ends located inside of the front end 31 of the ground electrode 30 and not exposed to the outside. Namely, at least the bent portion 34 of the ground electrode 30 has a three-layer structure in which three structural members are laminated together (i.e. the outer surface of the first member 35 is doubly covered by the second and third members 36 and 37).

The first structural member 35 is made of a single metal element such as Ni, Fe or an alloy thereof and functions to secure the breakage resistance of the ground electrode 30 and the strength of joint between the ground electrode 30 and the metal shell 50. The second structural member 36 is made of a single metal element such as Cu, Fe, Ag, Au or a highly thermal conductive alloy containing any of these elements as a main component and functions to radiate heat applied to the ground electrode 30 and applied to an electrode tip 95 on the front end 31 of the ground electrode 30 to the metal shell 50. The third structural member 37 is made of a nickel alloy such as Inconel 600 or 601 (trademark) having high corrosion resistance and stiffness and functions to, when the ground electrode 30 is subjected to repeated air-fuel mixture combustion in the combustion chamber, inhibit oxidation of the ground electrode 30 and withstand combustion pressure to prevent a breakage in the ground electrode 30.

The electrode tip 95 is joined to the front end 31 of the ground electrode 30 so as to protrude in needle-like form from the inner surface 33 of the front end 31 of the ground electrode 30 and face the electrode tip 90 joined to the front end 22 of the center electrode 20, thereby defining a spark gap G between the electrode tips 90 and 95. The electrode tip 95 is made of a noble metal such as Pt, Ir or Rb having high spark wear resistance and formed into a rod shape with a cross sectional area (an area of a cross section taken perpendicular to a direction of protrusion of the electrode tip 95) S of 0.20 to 1.13 $mm^2$ and a protrusion length (a length of protrusion of the electrode tip 95 from the inner surface 33 toward the spark gap G) H of 0.5 mm or larger. As the electrode tips 90 and 95 protrude from the center and ground electrodes 20 and 30, respectively, it is possible to generate a spark discharge between these electrodes actively in the spark gap G and to prevent a resulting flame core from coming into contact with and being quenched by the ground electrode 30 in the initial stage of flame growth.

The above-structured spark plug 100 of the present embodiment is made small in diameter such that the thread of the mounting thread portion 52 of the metal shell 50 has a nominal diameter of M12 or smaller based on JIS B8031 (1995). In this sparkplug 100, the radial distance between the center electrode 20 and the ground electrode 30 is made smaller. The degree of bending of the bent portion 34 is thus increased in such a manner as to secure a portion of the ground electrode 30 extending in the direction of the axis O and allow the ground electrode 30 to be bent at as front a position as possible. More specifically, the bending degree of the bent portion 34 is controlled to a curvature radius R of 2.3 mm or smaller where the curvature radius R is the minimum curvature radius R of the inner surface 33 of the bent portion 34 of the ground electrode 30 (as indicated by a two-dot chain line in the drawing). In other words, the curvature radius (minimum curvature radius) R is defined as that of the smallest curvature radius part, i.e., the part on which the bending degree of the inner surface 33 of the bent portion 34 is the largest when the ground electrode 30 is viewed in cross section taken along a plane including the axis O and the center of a cross section taken perpendicular to a longitudinal direction of the ground electrode 30. For convenience, the minimum curvature radius of the inner surface of the bent portion of the ground electrode is hereinafter just referred to as "curvature radius".

As will be demonstrated later by Experiment 1, when the curvature radius R is larger than 2.3 mm, the degree of internal stress in the bent portion 34 of the ground electrode 30 is originally low so that the life of the ground electrode 30 (the number of cycles to breakage of the ground electrode 30 by high load application) would not be so significantly decreased under the influence of the internal stress. When the curvature radius R is smaller than or equal to 2.3 mm and is thus smaller than a conventional level, however, the degree of internal stress in the bent portion 34 of the ground electrode 30 becomes high so that it is likely that the life of the ground electrode 30 would be influenced by the increase of internal stress in the bent portion 34.

Further, the influence of vibrational load on the bent portion 34 during engine driving is small when the electrode tip 95 is of plate-like shape and is smaller in weight than that of the needle-like shape. When the needle-like electrode tip 95 having a cross sectional area of 0.20 to 1.13 $mm^2$ and a protrusion length II of 0.5 mm or longer is joined to the end (front end 31) of the ground electrode 30, however, the weight exerted on the end of the ground electrode 30 becomes high so that it is likely that, at the time the ground electrode 30 is subjected to vibrational load during engine driving, the load will act on the bent portion 34 to cause an increase in internal stress under the weight of the electrode tip 95.

In this way, the internal stress is likely to increase, notably in the bent portion 34, in the case where the ground electrode 30 with the needle-like electrode tip 95 is applied to the small-diameter spark plug 100. Even in such a case, the ground electrode 30 is able to secure metal fatigue strength such that the internal stress in the bent portion 34 is made unlikely to exceed a fatigue limit by increasing the heat radiation ability of the ground electrode 30 and reducing thermal stress on the ground electrode 30. This increases the breakage resistance of the ground electrode 30 and improves the life of the ground electrode 30 significantly. More specifically, when the ground electrode 30 has a layer structure of two or more structural members, it is possible to increase the heat radiation ability of the ground electrode 30 and improve the life of the ground electrode 30, regardless of the compositional ratio of the respective structural members, by selecting the materials of the structural members of the ground electrode 30 in such a manner that the total thermal conductivity X of the ground electrode 30 as expressed by the following general formula (1) is 35 W/(m·K) or higher at 20° C.

[Formula 2]

$$X = \frac{\text{volume of first structural member}}{\text{volume of ground electrode}} \times \text{thermal conductivity of first structural member} + \sum_{i=2}^{n}\left(\frac{\text{volume of } ith \text{ structural member}}{\text{volume of ground electrode}} \times \text{thermal conductivity of } ith \text{ structural member}\right) \quad (1)$$

where n is an integer of 2 to 5 indicating the maximum number of the structural members of the ground electrode. As the ground electrode 30 has a three-layer structure of first, second and third structural members 35, 36 and 37 in the present embodiment, the total thermal conductivity X of the ground electrode 30 at 20° C. is expressed by the following equation:

$$X=[\{v1/(v1+v2+v3)\}\times x1]+[\{v2/(v1+v2+v3)\}\times x2]+[\{v3/(v1+v2+v3)\}\times x3]$$

where x1, x2 and x3 (W/(m·K)) are the thermal conductivities of the first, second and third structural members 35, 36 and 37 at 20° C.; and v1, v2 and v3 ($mm^3$) are the volumes of the first, second and third structural members 35, 36 and 37, respectively.

The volumes of the structural members of the ground electrode 30 can be determined by, for example, making cross-section analyses of the ground electrode 30 by X-ray spectroscopy etc. at regular intervals (of e.g. 1 mm) throughout its length, calculating the areas of the structural members in each cross section, and then, evaluating the integrals of the cross section areas of the structural members, respectively.

When the total thermal conductivity X of the ground electrode 30 is 35 W/(m·K) or higher at 20° C., the ground electrode 30 allows the heat applied to the ground electrode 30 and the electrode tip 95 to escape to the metal shell 50 adequately and prevents thermal deterioration of the metal fatigue strength as will be demonstrated later by Experiment 2. The ground electrode 30 is thus able to increase the breakage resistance of the bent portion 34, in which the internal stress is particularly likely to increase, and to obtain sufficient life improvement effect even in repeated cycles of heating and cooling during engine driving.

On the other hand, it is desired that the front end 31 of the ground electrode 30 protrudes more from the front end face 57 of the metal shell 50 in the direction of the axis O in order to secure a sufficient size of the spark gap G between the electrode tip 90 on the front end 22 of the center electrode 20 and the electrode tip 95 on the front end 31 of the ground electrode 30. There is however a possibility that the metal fatigue strength may deteriorate by heat as the entire length of the ground electrode 30 (from the front end 31 through the rear end 32), i.e., the length of the heat radiation passage of the ground electrode 30 increases with the length L by which the front end 31 of the ground electrode 30 protrudes from the front end face 57 of the metal shell 50 in the direction of the axis O. In addition, the weight of the ground electrode 30 increases with the protrusion length L. It is thus likely that the internal stress in the bent portion 34 will increase at the time the ground electrode 30 is subjected to vibrational load during engine driving. Even in this case, it is possible by setting the total thermal conductivity X of the ground electrode 30 to 35 W/(m·K) or higher to prevent thermal deterioration of the metal fatigue strength and improve the life of the ground electrode 30 sufficiently in repeated cycles of heating and cooling during engine driving. When the ground electrode 30 is short in length with a protrusion length L of smaller than 4.5 mm, the heat radiation passage is so short that the life of the ground electrode 30 is originally unlikely to be influenced by the protrusion length L. As will be demonstrated later by Experiment 3, the life improvement effect of the ground electrode 30 is pronounced when the protrusion length L is larger than or equal to 4.5 mm.

Furthermore, it is known that a high thermal conductivity material is generally low in tensile strength. The breakage resistance of the ground electrode 30 becomes lowered when the ground electrode 30 utilizes a low tensile strength material to attain higher heat radiation ability. It is thus preferable to control the total tensile strength Y of the ground electrode 30 as expressed by the following general formula (2) to higher than 55 $kgf/mm^2$ at 20° C.

[Formula 3]

$$Y = \frac{\text{volume of first structural member}}{\text{volume of ground electrode}} \times \text{tensile strength of first structural member} + \sum_{i=2}^{n}\left(\frac{\text{volume of } ith \text{ structural member}}{\text{volume of ground electrode}} \times \text{tensile strength of } ith \text{ structural member}\right) \quad (2)$$

where n is an integer of 2 to 5 indicating the maximum number of the structural members of the ground electrode. As the ground electrode 30 has a three-layer structure of first, second and third structural members 35, 36 and 37 in the present embodiment, the total tensile strength Y of the ground electrode 30 at 20° C. is expressed by the following equation:

$$Y=[\{v1/(v1+v2+v3)\}\times y1]+[\{v2/(v1+v2+v3)\}\times y2]+[\{v3/(v1+v2+v3)\}\times y3]$$

where y1, y2 and y3 ($kgf/mm^2$) are the tensile strengths of the first, second and third structural members 35, 36 and 37 at 20° C., respectively.

As will be demonstrated by Experiment 4, it is possible to increase the heat radiation ability of the ground electrode 30 sufficiently without a deterioration in breakage resistance and improve the life of the ground electrode 30, regardless of the compositional ratio of the respective laminated structure members, by setting the total tensile strength Y of the ground electrode 30 to be higher than 55 kgf/mm$^2$ at 20° C. When the total tensile strength Y of the ground electrode 30 is lower than or equal to 55 kgf/mm$^2$ at 20° C., the ground electrode 3 may fail to attain high rigidity and cannot obtain a life improvement effect commensurate with the increase in the total thermal conductivity X.

It is further preferable that the minimum curvature radius R of the side surface (inner surface 33) of the bent portion 34 of the ground electrode 30 is 1.0 mm or larger. When the curvature radius R is smaller than 1.0 mm, the internal stress in the bent portion 34 increases due to the large bending degree of the bent portion 34 so that it may be difficult to increase the breakage resistance of the ground electrode 30 and improve the life of the ground electrode 30 even if the heat radiation ability of the ground electrode 30 is increased to reduce thermal load and secure metal fatigue strength.

It is also preferable that the proportion of the volume of any of the structural members of the ground electrode 30 made of so-called good thermal conductivity material in the total volume of the ground electrode 30 is in the range of 12.5% to 57.5%. Herein, the good thermal conductivity material specifically refers to a material having a thermal conductivity of 50 W/(m·K) or higher at 20° C. It can be said according to the above general formula (1) that the total thermal conductivity X of the ground electrode 30 decreases with the proportion of the volume of any of the structural members of the ground electrode 30 made of high (good) thermal conductivity material in the total volume of the ground electrode 30. As will be demonstrated later by Experiment 5, the total thermal conductivity of the ground electrode 30 becomes lowered to cause a deterioration in heat radiation ability so that it may be difficult to reduce thermal load on the bent portion 34 and secure the breakage resistance of the ground electrode 30 when the proportion of the volume of any of the structural members of the ground electrode 30 made of good thermal conductivity material in the total volume of the ground electrode 30 is lower than 12.5%. It can be said according to the above general formula (2) that the total tensile strength Y of the ground electrode 30 decreases with increase in the proportion of the volume of any of the structural members of the ground electrode 30 made of high (good) thermal conductivity material in the total volume of the ground electrode 30. As will be demonstrated later by Experiment 5, the total tensile strength of the ground electrode 30 becomes lowered so that it may be difficult to provide the bent portion 34 with sufficient yield strength against internal stress and secure the breakage resistance of the ground electrode 30 when the proportion of the volume of any of the structural members of the ground electrode 30 made of good thermal conductivity material in the total volume of the ground electrode 30 is higher than 57.5%. For these reasons, the breakage resistance of the ground electrode 30 can be secured more assuredly by controlling the above volume proportion to within 12.5 to 57.5%.

As shown in FIG. 2, it is desirable to control the area of a cross section of the ground electrode 30 taken perpendicular to a center line P, which passes through the center of a cross section of the ground electrode 30 taken perpendicular to a direction from the base end 32 to the front end 31, to within the range of 1.5 mm$^2$ to 5.0 mm$^2$. The ground electrode 30 having a layer structure of two or more structural members is produced by forming cup-shaped raw materials for the respective structural layer members, putting these materials together sequentially, and then, extruding the resulting laminate of the materials. When the area of the cross section of the ground electrode 30 taken perpendicular to the center line P is smaller than 1.5 mm$^2$, the ground electrode 30 is thin so that the structural layer members of the ground electrode 30 are small in thickness. In this case, it may be difficult to secure the breakage resistance of the ground electrode 30 even if the ground electrode 30 is formed using high tensile strength material. When the area of the cross section of the ground electrode 30 taken perpendicular to the center line P is larger than 5.0 mm$^2$, the ground electrode 30 is so thick that it may be difficult to secure the productivity of the ground electrode 30 due to the difficulty of bending the ground electrode 30 for formation of the bent portion 34. The ground electrode 30 can secure breakage resistance and increase in production efficiency by controlling the area of the cross section of the ground electrode 30 perpendicular to the center line P to 1.5 mm$^2$ to 5.0 mm$^2$.

It is also desirable to, when one of the structural members of the ground electrode 30 having the highest thermal conductivity at 20° C. (in the present embodiment, the second member 36) is covered by any other one of the structural members of the ground electrode 30 having a thermal conductivity of lower than 50 W/(m·K) at 20° C., control the length of the ground electrode 30, the length of the structural layer member of the ground electrode 30 having the highest thermal conductivity at 20° C. and the joining position of the electrode tip 95 in such a manner as to satisfy the condition of 5.5 mm$\leqq C<B\leqq A\leqq$11.5 mm where A is the length of the ground electrode 30 along a first center line P passing through the center of a cross section of the ground electrode 30 taken perpendicular to the direction from one end (base end 32) to the other end (front end 31) of the ground electrode 30; B is, when a second center line Q passing through the center of a cross section of the electrode tip 95 taken perpendicular to the direction of protrusion of the electrode tip 95 from the front end 31 toward the spark gap G is projected on a plane including the first center line P, the length from an intersection of the first center line P and the second center line Q to an edge of the base end 32 along the first center line P; and C is the length of the structural layer member having the highest thermal conductivity at 20° C. from the edge of the base end 32 toward the front end 31 along the first center line P as shown in FIG. 2.

If the condition of C<B is not satisfied, at least the structural layer member of the ground electrode 30 having the highest thermal conductivity at 20° C. is located directly below the joining position of the electrode tip 95 on the inner surface 33 of the front end 31 of the ground electrode 30 (i.e. within the region on which the joining position is projected along the center line Q). At the time of joining the ground electrode 30 and the electrode tip 95 together during the production process of the spark plug 100, welding heat applied to the joint position may be readily radiated. If the welding heat applied is insufficient, the formation of a fused region between the ground electrode 30 and the electrode tip 95 is interfered so that the electrode tip 95 may not be joined adequately.

If the overall length of the ground electrode 30 is increased to satisfy the condition of A>11.5 mm, the influence of the weight of the base end 32 on the bent portion 34 increases as the front end 31 of the ground electrode 30 becomes large in size. It is thus likely that the internal stress in the bent portion 34 will increase at the time the ground electrode 30 is subjected to vibrational load during engine driving. This makes it difficult to secure the breakage resistance of the ground electrode 30. If the overall length of the ground electrode 30 is decreased to satisfy the condition of A<5.5 mm, the influence of the weight of the base end 32 on the bent portion 34 decreases as the front end 31 of the ground electrode 30 becomes small in size. This makes it possible to reduce the internal stress in the bent portion 34 and secure the breakage resistance of the ground electrode 30, but makes it difficult to improve the breakage resistance of the ground electrode 30 by reducing thermal load and ensuring metal fatigue strength.

The present invention will be described in more detail with reference to the following examples. It should be however noted that the following examples are only illustrative and not intended to limit the invention thereto.

EXPERIMENT 1

In Experiment 1, an evaluation test was conducted to verify the relationship between the bending degree of the bent portion 34 of the ground electrode 30 and the life of the ground electrode 30. For the evaluation test, a plurality of ground electrodes, each of which had a three-layer structure consisting of first, second and third structural members and showed a total thermal conductivity X of 15 W/(m·K) or 45 W/(m·K) as determined by the formula (1), were prepared. Further, needle-like electrode tips having a cross sectional area S of 0.38 $mm^2$ (ϕ: 0.7 mm) and a protrusion length H of 0.8 mm and plate-like electrode tips having a cross sectional area S of 0.38 $mm^2$ and a protrusion length H of 0.2 mm were prepared and joined with two kinds of the ground electrodes having the above total thermal conductivity values X. Samples of spark plugs were assembled using these ground electrodes with the electrode tips. In each of the spark plug samples, the ground electrode was subjected to bending to form a bent portion and define a spark gap G by controlling the curvature radius R of the inner surface of the ground electrode to within the range of 0.5 to 3.0 mm. The evaluation test was conducted by mounting the thus-produced spark plug sample in a 450-cc single-cylinder test engine and driving the engine to apply thermal and vibrational load to the spark plug sample according to a no-load racing pattern. The no-load racing pattern is a test pattern for shifting the engine from an idle state to a full-throttle state (8000 rpm) in a stroke and then shifting the engine back to an idle state. The test of the sample according to the no-load racing pattern is suitable for breakage resistance evaluation of the ground electrode since the ground electrode can be subjected to considerably high vibrational load. By regarding a single occasion of this driving pattern as one cycle, each of the test samples was tested for the number of cycles to breakage of the ground electrode (the life of the ground electrode). The test results are indicated in FIG. 3.

Figure 3:
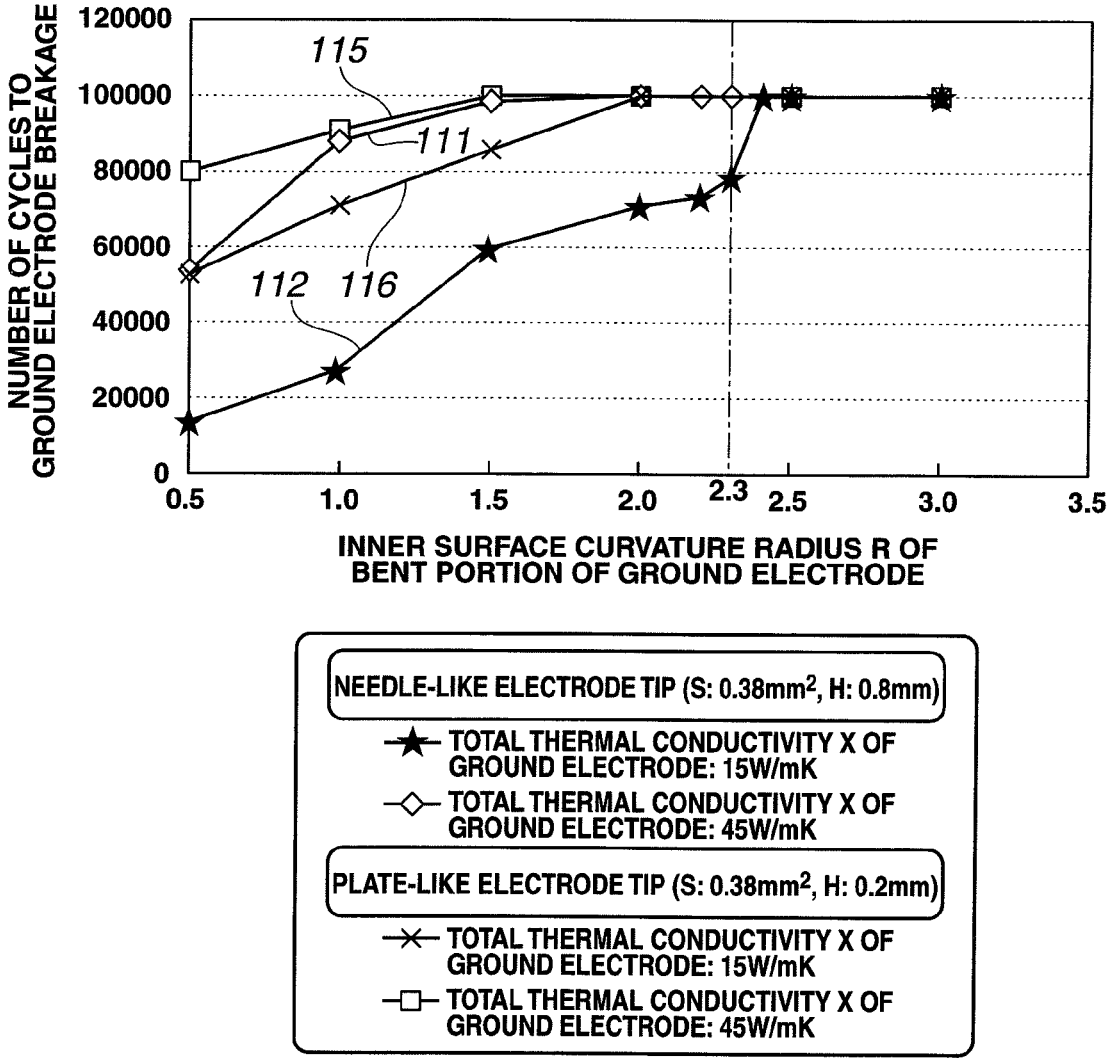
FIG. 3 is a graph showing a relationship between the bending degree (curvature radius R) of a bent portion of a ground electrode and the life (number of cycles to breakage) of the ground electrode.

As shown in FIG. 3, the life of the ground electrode was about 90000 cycles when the curvature radius R of the bent portion was 1.0 mm and was about 100000 cycles when the curvature radius R of the bent portion was 1.5 mm or larger (as indicated by line graph 115) in the case where the ground electrode was formed with a total thermal conductivity X of 45 W/(m·K) and joined with the plate-like electrode tip. In the case where the total thermal conductivity X of this ground electrode was changed to 15 W/(m·K), the life of the ground electrode was substantially equivalent to that of the case where the total thermal conductivity X was 45 W/(m·K) when the curvature radius R of the bent portion was larger than 1.5 mm and was deteriorated when the curvature radius R of the bent portion was 1.5 mm or smaller (as indicated by line graph 116). In the case where the ground electrode was formed with a total thermal conductivity X of 45 W/(m·K) and joined with the needle-like electrode tip, by contrast, the life of the ground electrode was substantially equivalent to that of the case where the plate-like electrode tip was joined (as indicated by line graph 111). In the case where the total thermal conductivity X of this ground electrode was changed to 15 W/(m·K), the life of the ground electrode was substantially equivalent to that of the case where the total thermal conductivity X was 45 W/(m·K) when the curvature radius R of the bent portion was larger than 2.3 mm and was deteriorated when the curvature radius R of the bent portion was 2.3 mm or smaller (as indicated by line graph 112). In each type of the samples, the life of the ground electrode was deteriorated more considerably when the curvature radius R of the bent portion was 0.5 mm. When the curvature radius R of the bent portion was 0.5 mm, the life of the ground electrode was shorter than about 60000 cycles except in the case where the ground electrode was formed with a total thermal conductivity X of 45 W/(m·K) and joined with the plate-like electrode tip and was only about 80000 cycle even in the case where the plate-like electrode tip was joined.

There was little difference in life between the ground electrode to which the plate-like electrode tip was joined (line graph 115) and the ground electrode to which the needle-like electrode tip was joined to cause increase in weight (line graph 111) in the case where the ground electrode had a total thermal conductivity X of 45 W/(m·K) and exhibited a favorable heat radiation ability. In the case where the total thermal conductivity X of the ground electrode was at a low level of 15 W/(m·K), however, the life of the ground electrode to which the needle-like electrode tip was joined to cause increase in weight (line graph 112) had a greater degree of deterioration that of the ground electrode to which the plate-like electrode tip (line graph 116) was joined. As seen from comparison of line graphs 115 and 116, there was little deterioration in the life of the ground electrode joined with the plate-like electrode tip even if the ground electrode had a total thermal conductivity X and did not exhibit a favorable heat radiation ability when the curvature radius R of the bent portion was larger than 1.5 mm. Similarly, there was little deterioration in the life of the ground electrode joined with the needle-like electrode tip even if the total thermal conductivity X of the ground electrode was lowered when the curvature radius R of the bent portion was larger than 2.3 mm as seen from comparison of line graphs 111 and 112. As the degree of internal stress in the bent portion increases with decrease in the curvature radius R of the bent portion, the ground electrode decreases in metal fatigue strength under thermal load and becomes more susceptible to breakage. This leads to deterioration of the life of the ground electrode is deteriorated. Accordingly, it has been shown that it is possible for the ground electrode to obtain a larger life improvement effect by raising the total thermal conductivity X of the ground electrode and increasing the heat radiation ability of the ground electrode when the ground electrode is joined with the needle-like electrode tip, which applies larger weight load than the plate-like electrode tip, and is formed with a curvature radius R of the bent portion of 2.3 mm or smaller.

When the curvature radius R of the bent portion was smaller than 1.0 mm, the life of the ground electrode was shorter than about 90000 cycles regardless of whether the ground electrode had a favorable total thermal conductivity X of 45 W/(m·K). It is because the life deterioration effect of the ground electrode caused by the increase of internal stress in the bent portion due to the large bending degree was larger than the life improvement effect of the ground electrode obtained by increase of the total thermal conductivity X and improvement of the heat radiation ability.

EXPERIMENT 2

In Experiment 2, an evaluation test was conducted to verify the relationship between the total thermal conductivity X of the ground electrode 30 and the life of the ground electrode 30. For the evaluation test, ground electrodes, each of which had a three-layer structure of first, second and third structural members as in the case of Experiment 1 and showed a total thermal conductivity X of 15 to 110 W/(m·K) as determined by the formula (1), were prepared. Herein, there were prepared 3 pieces of the ground electrode per each thermal conductivity level X. Further, needle-like electrode tips having a cross sectional area S of 0.38 $mm^2$ (ϕ: 0.7 mm) and a protrusion length H of 0.8 mm were prepared and joined to the respective ground electrodes. Samples of spark plugs were completed by forming bent portions in the ground electrodes in such a manner as to control the inner surface curvature radii R of the ground electrodes to three different levels: 1.0, 1.5 and 2.0 mm per each thermal conductivity level X. The evaluation test was conducted by applying thermal and vibrational load to the thus-produced spark plug sample according to a no-load racing pattern as in the case of Experiment 1. Each of the test samples was tested for the number of cycles to breakage of the ground electrode (the life of the ground electrode). The sample where the ground electrode had a total thermal conductivity X of 15 W/(m·K) was set as a reference sample, and the cycle number of the reference sample was normalized to 0. The amount of increase in the cycle number of each sample relative to the cycle number of the reference sample was calculated and summarized according to the curvature radius R. The test results are indicated in FIG. 4.

Figure 4:
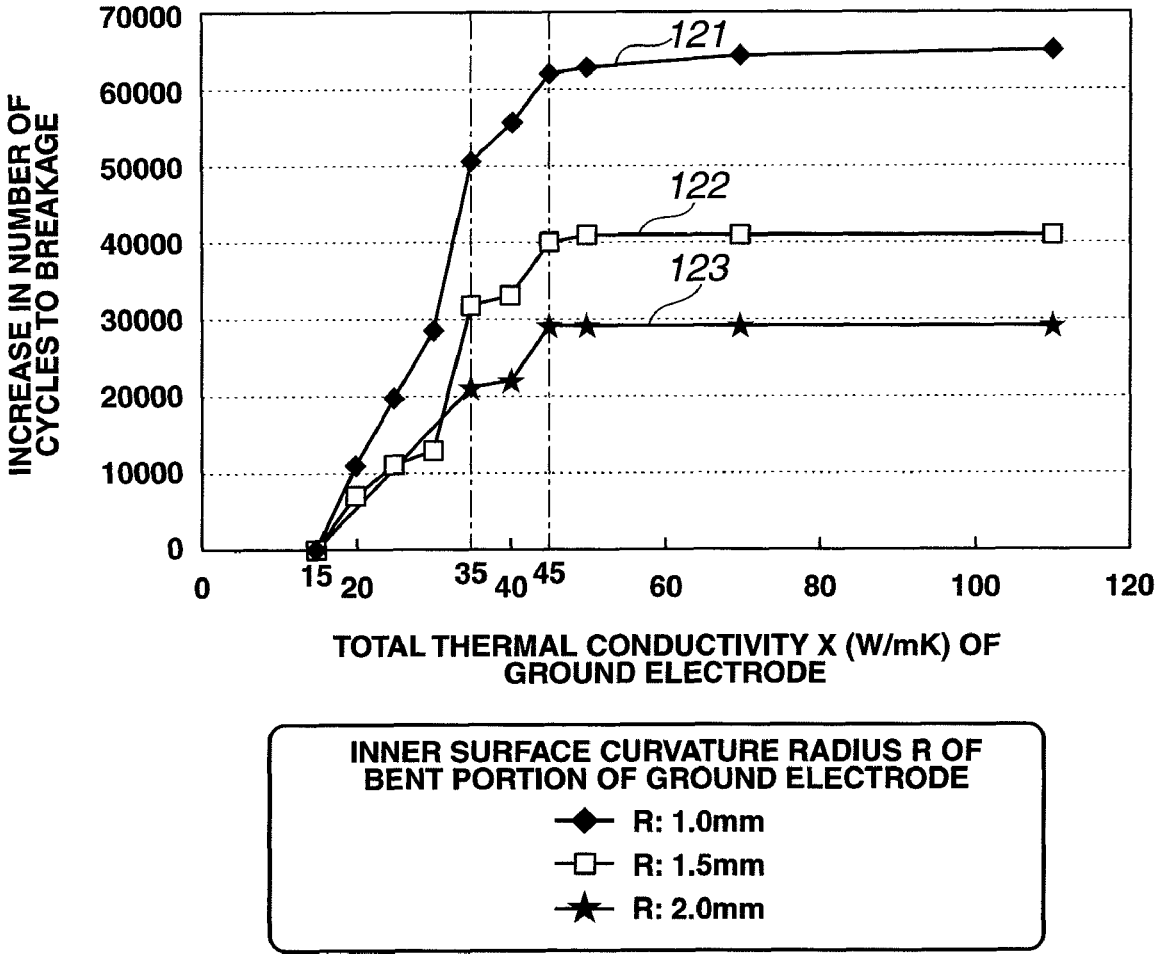
FIG. 4 is a graph showing a relationship between the total thermal conductivity X of the ground electrode and the life (number of cycles to breakage) of the ground electrode.

As shown in FIG. 4, the life of the ground electrode was improved by raising the total thermal conductivity X and increasing the heat radiation ability regardless of whether the curvature radius R of the bent portion was controlled to any level (line graphs 121, 122 and 123). The life improvement effect of the ground electrode was more pronounced as the curvature radius R of the bent portion decreased. This was also verified by the comparison result of line graphs 111 and 112 of Experiment 1. It has been thus shown that the life deterioration degree of the ground electrode, namely the breakage resistance improvement effect of the ground electrode, increases with decrease in the curvature radius R of the bent portion.

As seen from the test results of the samples where the curvature radius R of the bent portion was 1.0 mm (line graph 121) and the samples where the curvature radius R of the bent portion was 1.5 mm (line graph 122), the life improvement effect of the ground electrode increased with the total thermal conductivity X and became significantly increased when the total thermal conductivity X of the ground electrode was 35 W/(m·K) or higher. It has been shown that it is desirable to control the total thermal conductivity X of the ground electrode to 35 W/(m·K) or higher in order to improve the breakage resistance of the ground electrode. Regardless of whether the curvature radius R of the bent portion was controlled to any level, the life improvement effect of the ground electrode was saturated when the total thermal conductivity X of the bent portion was 45 W/(m·K) or higher.

EXPERIMENT 3

In Experiment 3, an evaluation test was conducted to verify the relationship between the protrusion length L of the ground electrode 30 from the front end face 57 of the metal shell 50 and the life of the ground electrode 30. For the evaluation test, ground electrodes, each of which had a three-layer structure of first, second and third structural members as in the case of Experiment 1 and showed a total thermal conductivity X of 15 W/(m·K) or 45 W/(m·K) as determined by the formula (1), were prepared. These ground electrodes were cut to the entire lengths such that the ground electrodes were bent to form bent portions with a curvature radius R of 1.5 mm and to control the protrusion lengths L of the ground electrodes to within the range of 4.0 to 10.0 mm. (See FIG. 2.) Needle-like electrode tips having a cross sectional area S of 0.38 $mm^2$ and a protrusion length H of 0.8 mm were prepared and joined to the respective ground electrodes. Samples of spark plugs were completed using these ground electrodes with the electrode tips where the curvature radius R of the bent portion and the protrusion length L of the ground electrode were controlled to 1.5 mm and 4.0 to 10.0 mm, respectively. In each of the samples, the spark gap G was fixed to a given size. The position of the spark gap G depending on the protrusion length L of the ground electrode was controlled by adjusting the protrusion lengths of the center electrode and ceramic insulator from the front end face of the metal shell. The evaluation test was conducted by applying thermal and vibrational load to the thus-produced spark plug sample according to a no-load racing pattern as in the case of Experiment 1. Each of the test samples was tested for the number of cycles to breakage of the ground electrode (the life of the ground electrode). The test results are indicated in FIG. 5.

Figure 5:
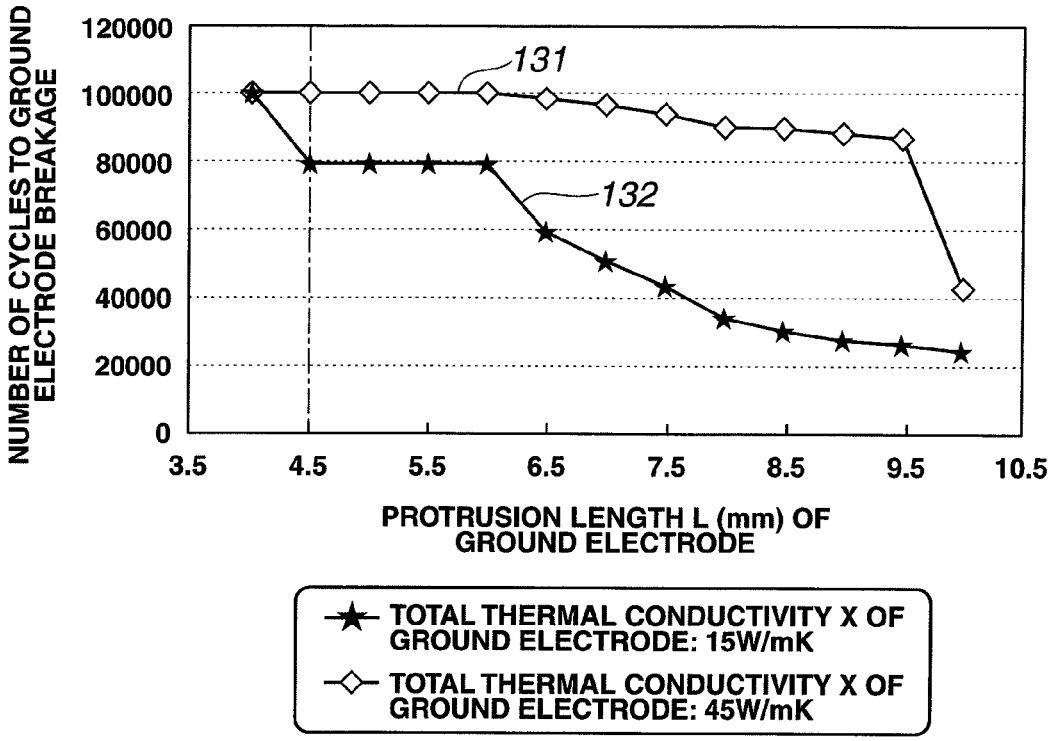
FIG. 5 is a graph showing a relationship between the length L of protrusion of the ground electrode from a front end face of a metal shell and the life (number of cycles to breakage) of the ground electrode.

In the case where the total thermal conductivity X of the ground electrode was 45 W/(m·K), the life of the ground electrode was deteriorated abruptly when the protrusion length L exceeded 9.5 mm as shown in FIG. 5. The life of the ground electrode substantially leveled off and did not show a significant deterioration when the protrusion length L was 9.5 mm or smaller (line graph 131). It can be said that it is possible for the ground electrode to attain a sufficient heat radiation ability, prevent a decrease in metal fatigue strength and secure high breakage resistance even if the heat radiation passage increases in length when the total thermal conductivity X is high. In the case where the total thermal conductivity X of the ground electrode was 15 W/(m·K), by contrast, there was a tendency that the life of the ground electrode was deteriorated by about 20000 cycles when the protrusion length L reached 4.5 mm and further deteriorated abruptly when the protrusion length L exceeded 6.0 mm (line graph 132). It has been confirmed that, when the protrusion length L of the ground electrode is 9.5 mm or longer, it is possible to improve the life of the ground electrode effectively by raising the total thermal conductivity X and increasing the heat radiation ability of the ground electrode. It has also been confirmed that the above improvement effect can be obtained when the protrusion length L of the ground electrode is 4.5 mm or longer and becomes more pronounced especially when the protrusion length L of the ground electrode is 6.5 mm or longer.

EXPERIMENT 4

In Experiment 4, an evaluation test was conducted to verify the relationship between the total tensile strength Y of the ground electrode 30 and the life of the ground electrode 30. For the evaluation test, a plurality of ground electrodes, each of which had a three-layer structure of first, second and third structural members as in the case of Experiment 1 and showed a total thermal conductivity X of 45 W/(m·K) as determined by the formula (1) and a total tensile strength Y of 53 to 61 $kgf/mm^2$ as determined by the formula (2), were prepared. More specifically, the total thermal conductivity X and the total tensile strength Y were controlled to the above values by setting the tensile strengths of the first, second and third structural members are set to 40, 38 and 70 $kgf/mm^2$, respectively, and adjusting the volume ratio of the structural members. Needle-like electrode tips having a cross sectional area S of 0.38 $mm^2$ (φ: 0.7 mm) and a protrusion length H of 0.8 mm were prepared and joined to the respective ground electrodes. Samples of spark plugs were assembled using these ground electrodes with the electrode tips. In each of the spark plug samples, the ground electrode was subjected to bending to form a bent portion by controlling the curvature radius R of the inner surface of the ground electrode to 1.5 mm. The evaluation test was conducted by applying thermal and vibrational load to the thus-produced spark plug sample according to a no-load racing pattern as in the case of Experiment. Each of the test samples was tested for the number of cycles to breakage of the ground electrode (the life of the ground electrode). The sample where the total tensile strength of the ground electrode was 53 kgf/$mm^2$ was set as a reference sample, and the cycle number of the reference sample was normalized to 0. The amount of increase in the cycle number of each sample relative to the cycle number of the reference sample was calculated. The test results are indicated in FIG. 6.

Figure 6:
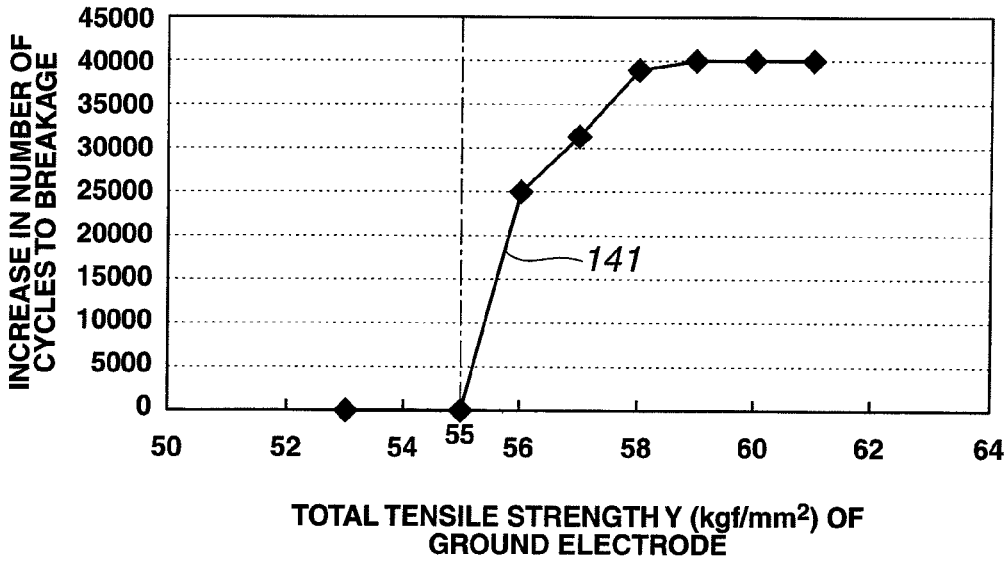
FIG. 6 is a graph showing a relationship between the total tensile strength Y of the ground electrode and the life (number of cycles to breakage) of the ground electrode.

As shown by line graph 141 in FIG. 6, the life of the ground electrode was not improved, regardless of whether the ground electrode had a total thermal conductivity X of 45 W/(m·K) and showed a high heat radiation ability, when the total tensile strength Y of the ground electrode was 55 kgf/$mm^2$ or lower. Namely, the ground electrode was not sufficient in strength. It has been thus confirmed that the life improvement effect of the ground electrode increases as the total tensile strength Y of the ground electrode becomes 55 kgf/$mm^2$ higher and gets saturated when the total tensile strength Y of the ground electrode becomes 59 kgf/$mm^2$ or higher.

EXPERIMENT 5

In Experiment 5, an evaluation test was conducted by simulation technique to verify the influence of the ratio of the volume of high thermal conductivity member to the total volume of the ground electrode on the total thermal conductivity X and the total tensile strength Y For the evaluation test, 17 kinds of samples of ground electrodes, each of which had a three-layer structure of first, second and third structural members as in the case of Experiment 1, were prepared by changing the volumes v1, v2 and v3 ($mm^3$) of the first, second and third structural members to different levels while setting the total volume V ($mm^3$) of the ground electrode to 35 $mm^3$. In each sample, the first structural member was formed using a material having a thermal conductivity x1 of 90.5 W/(m·K) at 20° C. and a tensile strength y1 of 38 kgf/$mm^2$ at 20° C. The second structural member was formed using a material having a thermal conductivity x2 of 398 W/(m·K) at 20° C. and a tensile strength y1 of 40.1 kgf/$mm^2$ at 20° C. Further, the third structural member was formed using a material having a thermal conductivity x3 of 11.1 W/(m·K) at 20° C. and a tensile strength y1 of 78.7 kgf/$mm^2$ at 20° C. Among the first to third structural members, the first and second structural members having a thermal conductivity higher than or equal to 50 W/(m·K) were regarded as high thermal conductivity members. Each of the samples was evaluated for the ratio (v1+v2)/V of the volume of these high thermal conductivity members to the total volume V of the ground electrode. The volume ratio (v1+v2)/V was varied from sample to sample within the range of 5.4 to 64.4%. Sample numbers 1 to 17 were herein assigned to these seventeen kinds of the samples (in ascending order of volume ratio, except for some sample). Also, each of the samples was evaluated for the total thermal conductivity X and the total tensile strength Y according to the formulas (1) and (2). The evaluation results are indicated in TABLE 1.

TABLE 1

| | Volume [$mm^3$] | | | | Volume ratio (v1 + v2)/V | Thermal conductivity [W/(m · K)] | | | Total thermal conductivity | Tensile strength [kgf/$mm^2$] | | | Total tensile strength Y |
|---|---|---|---|---|---|---|---|---|---|---|---|---|---|
| Sample | v1 | v2 | v3 | V | [%] | x1 | x2 | x3 | X [W/(m · K)] | y1 | y2 | y3 | [kgf/$mm^2$] |
| 1 | 1.9 | 0 | 33.2 | 35.1 | 5.4 | 90.5 | 398 | 11.1 | 15 | 40.1 | 38 | 78.7 | 77 |
| 2 | 1.3 | 0.5 | 33.3 | 35.1 | 5.1 | 90.5 | 398 | 11.1 | 20 | 40.1 | 38 | 78.7 | 77 |
| 3 | 1.4 | 1.0 | 32.7 | 35.1 | 6.8 | 90.5 | 398 | 11.1 | 25 | 40.1 | 38 | 78.7 | 76 |
| 4 | 2.0 | 1.3 | 31.8 | 35.1 | 9.4 | 90.5 | 398 | 11.1 | 30 | 40.1 | 38 | 78.7 | 75 |
| 5 | 2.8 | 1.6 | 30.7 | 35.1 | 12.5 | 90.5 | 398 | 11.1 | 35 | 40.1 | 38 | 78.7 | 74 |
| 6 | 2.9 | 2.0 | 30.2 | 35.1 | 14.0 | 90.5 | 398 | 11.1 | 40 | 40.1 | 38 | 78.7 | 73 |
| 7 | 3.6 | 2.3 | 29.2 | 35.1 | 16.8 | 90.5 | 398 | 11.1 | 45 | 40.1 | 38 | 78.7 | 72 |
| 8 | 3.7 | 2.8 | 28.6 | 35.1 | 18.5 | 90.5 | 398 | 11.1 | 50 | 40.1 | 38 | 78.7 | 71 |
| 9 | 5.5 | 4.2 | 25.4 | 35.1 | 27.6 | 90.5 | 398 | 11.1 | 70 | 40.1 | 38 | 78.7 | 68 |
| 10 | 9.0 | 7.1 | 19.0 | 35.1 | 45.9 | 90.5 | 398 | 11.1 | 110 | 40.1 | 38 | 78.7 | 61 |
| 11 | 9.2 | 7.8 | 18.1 | 35.1 | 48.4 | 90.5 | 398 | 11.1 | 118 | 40.1 | 38 | 78.7 | 60 |
| 12 | 10.1 | 7.8 | 17.2 | 35.1 | 51.0 | 90.5 | 398 | 11.1 | 120 | 40.1 | 38 | 78.7 | 59 |
| 13 | 10.8 | 7.9 | 16.4 | 35.1 | 53.3 | 90.5 | 398 | 11.1 | 123 | 40.1 | 38 | 78.7 | 58 |
| 14 | 11.4 | 8.2 | 15.5 | 35.1 | 55.8 | 90.5 | 398 | 11.1 | 127 | 40.1 | 38 | 78.7 | 57 |
| 15 | 12.0 | 8.2 | 14.9 | 35.1 | 57.5 | 90.5 | 398 | 11.1 | 129 | 40.1 | 38 | 78.7 | 56 |
| 16 | 12.5 | 8.9 | 13.7 | 35.1 | 61.0 | 90.5 | 398 | 11.1 | 137 | 40.1 | 38 | 78.7 | 55 |
| 17 | 13.3 | 9.3 | 12.5 | 35.1 | 64.4 | 90.5 | 398 | 11.1 | 144 | 40.1 | 38 | 78.7 | 53 |

As is seen from TABLE 1, the total thermal conductivity X decreased with the ratio of the volume (v1+v2) of the high thermal conductivity members to the total volume of the ground electrode. More specifically, the total thermal conductivity X was lower than 35 W/(m·K) in Sample Nos. 1 to 4 where the volume ratio was smaller than 12.5%. On the other hand, the total tensile strength Y increased with decrease in the ratio of the volume (v1+v2) of the high thermal conductivity members to the total volume of the ground electrode. More specifically, the total tensile strength Y was 55 kgf/$mm^2$ or lower in Sample Nos. 16 and 17 where the volume ratio was larger than 57.5%. According to the results of the above simulation test, it has been shown that it is desirable to control the volume ratio to 12.5% or larger in order for the ground electrode to secure a total thermal conductivity of 35 W/(m·K) or higher. It has also been shown that it is desirable to control the volume ratio to 57.5% or smaller in order for the ground electrode to secure a total tensile strength Y of higher than 55 kgf/$mm^2$.

Although the present invention has been described with reference to the specific embodiments, the invention is not limited to the above-described embodiments. Various modification and variation of the embodiments described above will occur to those skilled in the art in light of the above teaching.

The ground electrode 30 may have a two-layer structure of first and second structural members 35 and 36 although the ground electrode 30 has a three-layer structure of first, second and third structural members 35, 36 and 37 in the above embodiment. The ground electrode 30 may alternatively have a four-layer structure with an additional fourth structural member or a five-layer structure with a further additional fifth structural member. In each of these cases, the compositional ratio of the structural members is preferably determined in such a manner as to control the total thermal conductivity X as expressed by the formula [1] to 35 W/(m·K) or higher and to control the total tensile strength Y as expressed by the formula [2] to be higher than 55 kgf/mm$^2$.

The electrode tip 95 joined to the front end 31 of the ground electrode 30 may be formed by putting a plurality of metal materials together. For example, the electrode tip can be formed by stacking and joining a noble metal member of a noble metal and an intermediate member of a noble metal alloy (preferably, an alloy of noble metal and material of the outermost structural member (in the present embodiment, the third structural member 37) of the ground electrode) in two layers and then joined to the inner surface 33 of the ground electrode 30. In this case, it is preferable to locate the noble metal member of high spark wear resistance on the side of the spark gap G and to locate the intermediate member on the side of the ground electrode 30. This type of electrode tip allows, when heat is applied to the noble metal member, the heat to escape rapidly to the ground electrode through the intermediate member so that the heat is unlikely to be accumulated in the electrode tip. Further, this electrode tip allows the intermediate member to relieve a difference in thermal expansion coefficient between the noble metal member and the ground electrode and thereby reduce internal stress on each joint face so that the strength of joint between the ground electrode and the electrode tip can be increased to prevent the electrode tip from falling off. These features are advantageous for the ground electrode 30 of the present embodiment, which may decrease in joinability to the electrode tip due to the increase in the heat radiation ability. The ground electrode 30 of the present embodiment is able to withstand the weight of the electrode tip and radiate the heat from the electrode tip assuredly even when the above type of electrode tip is joined to the inner surface 33 of the ground electrode 30.

The invention claimed is:

1. A spark plug, comprising:

a center electrode;

a ceramic insulator having an axial hole extending in an axial direction and retaining the center electrode in the axial hole;

a metal shell surrounding a radial outer circumference of the ceramic insulator and retaining therein the ceramic insulator;

a ground electrode joined at one end thereof to a front end face of the metal shell and having a bent portion formed between the one end and the other end thereof in such a manner that the other end of the ground electrode faces a front end of the center electrode; and an electrode tip joined to the other end of the ground electrode at a position facing the front end of the center electrode and having a protrusion length of 0.5 mm or larger from the other end of the ground electrode and a cross sectional area of 0.20 to 1.13 mm$^2$, the ground electrode consisting of a first structural member extending from the one end toward the other end of the ground electrode and at least one ith structural member (i=2, 3, 4, 5) laminated to cover an outer surface of the first structural member;

the minimum curvature radius of a side surface of the bent portion facing the center electrode being 2.3 mm or smaller;

the length of protrusion of a point of the other end of the ground electrode protruding most in the axial direction from the front end face of the metal shell being 4.5 mm or larger;

the metal shell having a mounting thread formed with a nominal diameter of M12 or smaller based on JIS standard; and the total thermal conductivity X of the ground electrode as expressed by the formula [1] being 35 W/(m·K) or higher at 20° C.

[Formula 4]

$$X = \frac{\text{volume of first structual member}}{\text{volume of ground electrode}} \times \text{thermal conductivity of first structural member} + \sum_{i=2}^{n}\left(\frac{\text{volume of } ith \text{ structural member}}{\text{volume of ground electrode}} \times \text{thermal conductivity of } ith \text{ structural member}\right) \quad (1)$$

where n is an integer of 2 to 5 indicating the maximum number of the structural members of the ground electrode.

2. The spark plug according to claim 1, wherein the total tensile strength Y of the ground electrode as expressed by the formula [2] is higher than 55 kgf/mm$^2$ at 20° C.

[Formula 5]

$$Y = \frac{\text{volume of first structual member}}{\text{volume of ground electrode}} \times \text{tensile strength of first structural member} + \sum_{i=2}^{n}\left(\frac{\text{volume of } ith \text{ structural member}}{\text{volume of ground electrode}} \times \text{tensile strength of } ith \text{ structural member}\right) \quad (2)$$

where n is an integer of 2 to 5 indicating the maximum number of the structural members of the ground electrode.

3. The spark plug according to claim 1, wherein the minimum curvature radius of the side surface of the bent portion of the ground electrode is 1.0 mm or larger.

4. The spark plug according to claim 1, wherein the proportion of the volume of any of the structural members of the ground electrode made of high thermal conductivity material having a thermal conductivity of 50 W/(m·K) or higher at 20° C. in the total volume of the ground electrode is in the range of 12.5% to 57.5%.

5. The spark plug according to claim 1, wherein the area of a cross section of the ground electrode taken perpendicular to a direction from the one end to the other end of the ground electrode is in the range of 1.5 mm$^2$ to 5.0 mm$^2$.

6. The spark plug according to claim 1, wherein:

the structural member of the ground electrode having the highest thermal conductivity at 20° C. is covered by any other one of the structural members of the ground electrode having a thermal conductivity of lower than 50 W/(m·K) at 20° C.;

a first center line P is defined as a center line along a longitudinal direction of the ground electrode, such that the center line P passes through a center of any cross section of the ground electrode taken perpendicular to the longitudinal direction;

a second center line Q is defined as a center line passing through a center of a cross section of the electrode tip taken perpendicular to a direction of protrusion of the electrode tip; and the ground electrode satisfies a condition of 5.5 mm≦C<B≦A≦11.5 mm where A is a length of the ground electrode along the first center line P from the one end to the other end of the ground electrode; B is a length of the ground electrode along the first center line P from the one end of the ground electrode to an intersection with the second center line Q; and C is a length of the ground electrode along the first center line P from the one end to a terminating end of the structural member of the ground electrode having the highest thermal conductivity at 20° C.

* * * * *